US011920427B2

(12) United States Patent
Moe et al.

(10) Patent No.: US 11,920,427 B2
(45) Date of Patent: Mar. 5, 2024

(54) METHOD OF OPERATING A SUBSEA PRODUCTION SYSTEM, A SUBSEA TREE AND AN ELECTRIC DOWNHOLE SAFETY VALVE

(71) Applicant: FMC Kongsberg Subsea AS, Kongsberg (NO)

(72) Inventors: Sigurd Moe, Kongsberg (NO); John A. Johansen, Kongsberg (NO)

( * ) Notice: Subject to any disclaimer, the term of this patent is extended or adjusted under 35 U.S.C. 154(b) by 0 days.

(21) Appl. No.: 17/634,947

(22) PCT Filed: Aug. 17, 2020

(86) PCT No.: PCT/EP2020/073014

§ 371 (c)(1),
(2) Date: Feb. 11, 2022

(87) PCT Pub. No.: WO2021/032689

PCT Pub. Date: Feb. 25, 2021

(65) Prior Publication Data

US 2022/0275703 A1 Sep. 1, 2022

(30) Foreign Application Priority Data

Aug. 21, 2019 (NO) ..... 20191004

(51) Int. Cl.
*E21B 34/06* (2006.01)
*E21B 23/04* (2006.01)

(52) U.S. Cl.
CPC ..... *E21B 34/066* (2013.01); *E21B 23/04* (2013.01)

(58) Field of Classification Search
CPC ..... E21B 34/066
See application file for complete search history.

(56) References Cited

U.S. PATENT DOCUMENTS 8,490,687 B2 * 7/2013 Scott ..... E21B 34/066 166/373
2009/0038804 A1 * 2/2009 Going, III ..... E21B 34/10 166/66.6

(Continued)

FOREIGN PATENT DOCUMENTS

EP 1 138 873 A1 10/2001
WO WO 2005/111484 A2 11/2005

(Continued)

OTHER PUBLICATIONS

Schwerdtfeger et al., "World First All Electric Subsea Well", Society of Petroleum Engineers, SPE-186150-MS (Sep. 5-8, 2017).

*Primary Examiner* — Matthew R Buck

(57) ABSTRACT

A method of operating a subsea production system (1), the system comprising a subsea tree (2) connected to a subsea well (3), a production tubing (4) in the well (3), and an electrically operable electric downhole safety valve (5), wherein the method comprises, in case of malfunction in operation of the electric downhole safety valve (5), the steps of installing a hydraulically operable insert hydraulic downhole safety valve (6) within the production tubing (4); connecting the insert hydraulic downhole safety valve (6) to the fluid line (10) at a point of setting (7) in the subsea well (3); operating the insert hydraulic downhole safety valve (6) by using the fluid line (10) which extends from an input port (11) at a position outside of the subsea tree (2).

10 Claims, 4 Drawing Sheets

(56) References Cited

U.S. PATENT DOCUMENTS

| | | | |
|---|---|---|---|
| 2009/0277643 | A1 | 11/2009 | Mondelli et al. |
| 2014/0144649 | A1 | 5/2014 | Arrazola et al. |
| 2015/0275620 | A1 | 10/2015 | Scott et al. |
| 2021/0108487 | A1* | 4/2021 | Vick, Jr. ..... E21B 34/066 |

FOREIGN PATENT DOCUMENTS

| | | | |
|---|---|---|---|
| WO | WO 2009/076614 | A2 | 6/2009 |
| WO | WO 2015/188080 | A1 | 12/2015 |
| WO | WO 2017/155550 | A1 | 9/2017 |
| WO | WO 2017/204804 | A1 | 11/2017 |

* cited by examiner

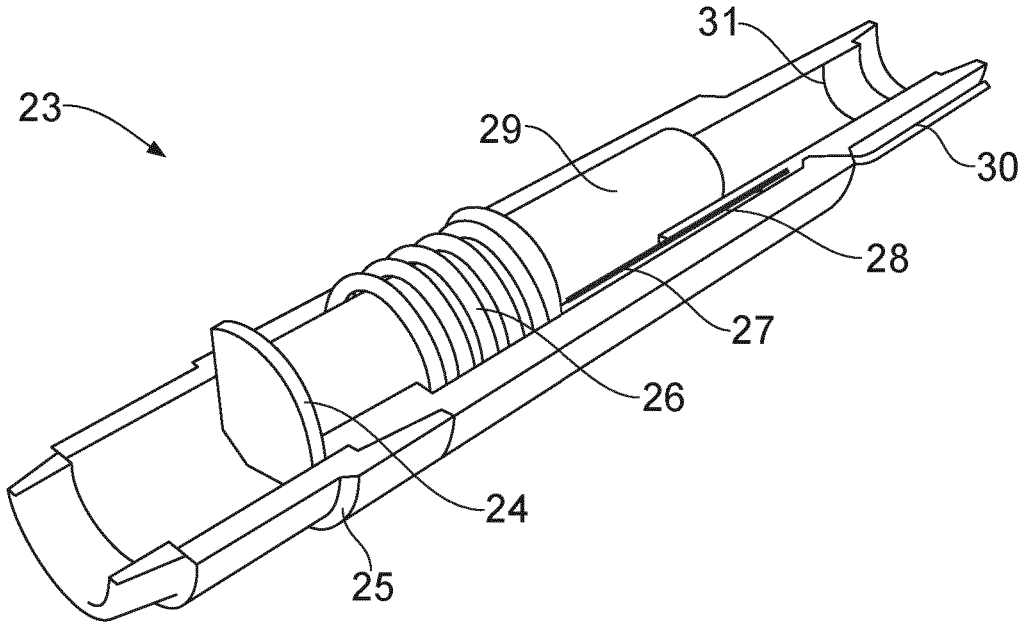
FIG. 2A (Prior Art TRSCSSV)
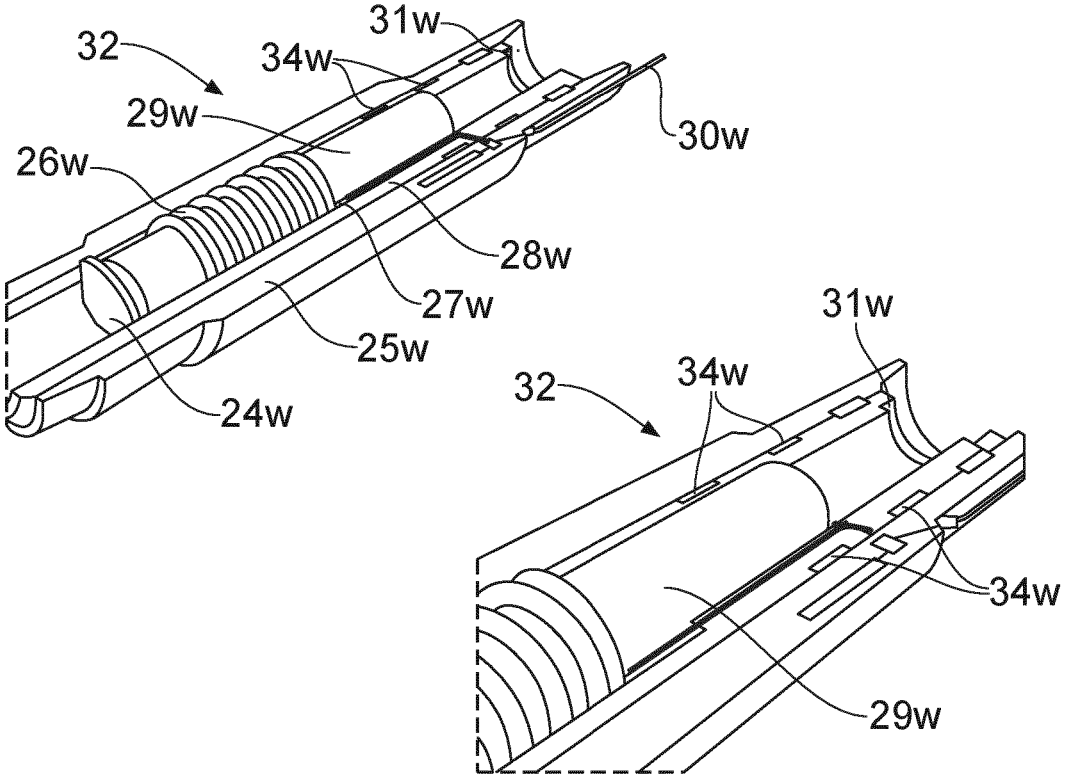
FIG. 2B (Prior Art WRSCSSV)

METHOD OF OPERATING A SUBSEA PRODUCTION SYSTEM, A SUBSEA TREE AND AN ELECTRIC DOWNHOLE SAFETY VALVE

The invention relates to a method of operating a subsea production system, a subsea production system, a subsea tree and an electric downhole safety valve with a backup solution in case of failure.

BACKGROUND OF THE INVENTION

Prior art includes fully all-electric subsea trees. One such all-electric subsea tree is disclosed in SPE Article, SPE-186150-MS, published on SPE Offshore Europe Conference & Exhibition, 5-8 Sep. 2017, Aberdeen, United Kingdom. Here it is described that an all-electric subsea well consists of an electric subsea Christmas tree, electric downhole safety valve, and associated subsea control modules. Valve control is established via an electric cable. Umbilicals used in hydraulic subsea operations are complex, difficult to install, and highly expensive. Replacing hydraulic fluid tubes by an electric cable within the umbilical can provide a 15% cost savings over a 30-km step-out. The technology also improves control of environmental impact by removing the risk of hydraulic fluid release.

A downhole safety valve is functioning as one of the barriers in the well, and is an important element. Normally such a valve will be tested for operation at regular intervals. An electrically operated downhole safety valve would normally be equipped with an A and B (redundant) electric operation system. In the event both of these fail in providing power to the downhole safety valve, the well is shut in and cannot be reopened until power (and communication) is re-established. One possible way of alleviating this is to install two electric downhole safety valves in series within the well. For hydraulically operated trees with a hydraulic operated downhole safety valve, there are provisions for setting an in-tubing insertable hydraulically operated downhole safety valve by wireline operations, to gain the same functionalities and barriers as the non-functional production tubing installed downhole safety valve.

The downhole safety valve (DHSV) is a primary well barrier element located in the "upper" completion string and comprises a valve unit and an actuator. The purpose of the downhole safety valve is to prevent uncontrolled flow of fluids from the reservoir and up the tubing in an emergency situation by closing the valve. The downhole safety valve is also sometimes referred to as surface controlled subsea safety valve (SCSSV).

For a hydraulically operated tree, the downhole safety valve is normally a hydraulically operated valve. The two major types of hydraulic operated downhole safety valves which comprises a flapper are the tubing retrievable surface controlled subsurface safety valve (TRSCSSV) and the wireline retrievable surface controlled subsurface safety valve (WRSCSSV).

The TRSCSSV is installed as part of the tubing string with threaded connections at the upper end (box) and lower end (pin) of the valve. This concept maintains the inside diameter (ID) of the production tubing string also through the safety valve.

The backup for the TRSCSSV for a hydraulic system is the WRSCSSV, which WRSCSSV is a wireline retrievable surface controlled subsurface safety valve. The WRSCSSV is basically a smaller diameter version of the TRSCSSV with main application as through-tubing conveyed means for remediation of TRSCSSV failures. The WRSCSSV is normally installed within the TRSCSSV taking advantage of the existing hydraulic line. The WRSCSSV is also named insert hydraulic downhole safety valve (DHSV).

For an electric tree or for a tree with an electric downhole safety valve, there are no hydraulic lines down to the position of the electric downhole safety valve as there is not need for a hydraulic connection as the valve is electrically operated, i.e. there is no hydraulic present and there is no hydraulic access. In other words, for an originally installed electric downhole safety valve which is electrically operated there are no provisions in the well for providing hydraulics to the position of the electrically operated electric downhole safety valve as there are no need for hydraulics. Such a safety valve would also normally have both an A and B (redundant) operation systems.

A problem may rise in the electric subsea trees or in any tree (electric or hydraulically operable) having an original installed electric downhole safety valve, in the event that the electric access to the electric downhole safety valve is (for any reason) restricted or fully prevented so that the redundant B system of the electric system does not work as the A system is not working, hence the electric downhole safety valve does not work properly.

It is an object of the invention to provide an alternative fallback solution for a tree and well with an electrically operable electric downhole safety valve, in the case the electric downhole safety valve does not work properly.

SUMMARY OF INVENTION

The invention is set forth in the independent claims, while the dependent claims describe other characteristics of the invention.

In all embodiments, as defined in the independent apparatus claim and in the independent method claims, a hydraulically operable insert hydraulic downhole safety valve is set in a subsea production system with a X-mas tree and originally electric downhole safety valve.

In one embodiment there is an electric subsea tree, also referred to as an electric tree or an all-electric subsea tree within the oil and gas industry, which is characterized in that it is electrically operated and that a traditional umbilical with a hydraulic fluid line as used in the oil and gas industry is superfluous because the operation of the valves in the electric subsea tree is done by electric communication/power only.

The production system comprises an electrically operated downhole safety valve, and since the system originally is intended to operate electrically, the system does not comprise a fluid or hydraulic line from the electric downhole safety valve to a power source on the seabed or at surface. According to the invention there is a need for a hydraulic source for the operation of a hydraulically operable insert hydraulic downhole safety valve and the source for hydraulics as used in the invention is arranged subsea, either being connected to surface or positioned on the seabed at or close to the subsea tree. This is the case in all embodiments of the invention.

The insert hydraulic downhole safety valve contingency solution used with Electric DHSV will provide different technologies for primary and contingency solutions and does not involve any common mode failures.

Although tubing retrievable downhole safety valves are installed in order to be able to shut down a well, there may be situations where it is desirable to test whether the safety valve is capable of shutting down a well (i.e. whether the valve is capable of performing its required function). The tubing retrievable downhole safety valves are tested at predetermined intervals where an operator instructs the safety valve to close, verifies that the safety valve has closed, instructs the safety valve to open, and verifies that the safety valve has opened. For an electrically operable downhole safety valve there are normally two electric modes of operation, A and B, where B would be acting as contingency for A in case that fails. In case both fails there are no further contingency solutions. The present invention provides for such a contingency solution by making provisions for and installing a wireline retrievable hydraulically operated downhole safety valve within the tubing of the production system. The production system may be full-electrical production system with an all-electric or electric tree.

For the electrically operated tubing retrievable downhole safety valve the fall back is the electric B channel For hydraulically operated tubing retrievable safety valves the procedure is to insert an insert hydraulic downhole safety valve into the hydraulically operated tubing retrievable downhole safety valve. This insert hydraulic downhole safety valve is normally set such that it forces the hydraulically operated tubing retrievable downhole safety valve open in order to avoid sudden un-intentional fully or partly closure of the flow in the production tubing.

According to the invention, it is described a method of operating a subsea production system, the system comprising a subsea tree connected to a subsea well, a production tubing in the well, and an electrically operable electric downhole safety valve, the subsea tree comprises a through-going bore forming part of a fluid line in the subsea production system down to a position at or close to the electric downhole safety valve, wherein the method comprises, in case of malfunction in operation of the electric downhole safety valve, the steps of:

- installing a hydraulically operable insert hydraulic downhole safety valve into the well for positioning within the production tubing;
- connecting the insert hydraulic downhole safety valve to the fluid line at a point of setting in the subsea well, for operation of the insert hydraulic downhole safety valve;
- operating the insert hydraulic downhole safety valve from a position outside the subsea tree by using the fluid line which extends from an input port at a position outside of the subsea tree to the point of setting in the subsea well via the through-going bore.

Thus, according to the invention, the subsea tree and tubing are prepared during original installation with a through-bore communicating from an opening at the outside of the tree to an opening at the position of the electric downhole safety valve via the through-going bore.

The procedure assumes contingency hydraulic line from the Xmas tree to a landing profile at the electric safety valve that was originally installed with the production tubing later combined with a fluid conduit from existing infrastructure in the field comprising either hydraulic or chemicals distribution or later installed subsea hydraulic power unit at seabed, and a control unit in communication with the insert hydraulic downhole safety valve.

The Electric DHSV may be equipped with redundant electrical supply and actuator components so this system will be more fault tolerant than a traditional hydraulic DHSV.

Conventional Wireline Retrievable insert hydraulic downhole safety valves (i.e. WRSCSSV) are normally prepared for being installed on wireline, thus already field-proven insert hydraulic downhole safety downhole valves may be used.

The hydraulic operable insert downhole safety valve is preferably run on wireline, but it may also be run on coiled tubing, drill string or other through tubing elements.

The subsea tree may be an electric subsea tree. Alternatively, the subsea tree may be a hydraulically operated subsea tree.

The system may comprise an implement profile below the subsea tree, and the method may comprise a step of:

- installing the insert hydraulic downhole safety valve in the implement profile.

The implement profile may comprise a shoulder, a landing profile or other additional no-go elements installed with the production tubing. The implement profile is preferably at the same position as the point or opening for the through bore of the hydraulics and is pre-installed but not normally used. It may be a plugged hydraulic access point in the tubing in the event the electric downhole safety valve fails and the insert hydraulic downhole safety valve shall be used instead.

If Tubing Retrievable Electric DHSV system fails: Install Wireline installable hydraulic DHSV in a landing profile above TRSCSSV by means of Riserless Well Intervention (RLWI) or rig tooling. This will be the same procedure as currently used for (hydraulic) TRSCSSVs.

The implement profile may be arranged between the subsea tree and the electric downhole safety valve, and the method may comprise a step of:

- installing the insert hydraulic downhole safety valve in the implement profile.

The implement profile may be provided in the electric downhole safety valve, and the method may comprise a step of:

- installing the insert hydraulic downhole safety valve in the implement profile in or close to the electric downhole safety valve, thereby forcing the electric downhole safety valve to an open position inactivating the electric downhole safety valve.

The method may further comprise, prior to the step of operating the hydraulically operable insert hydraulic downhole safety valve, a step of:

- installing a fluid conduit from existing infrastructure in the field comprising either hydraulic or chemicals distribution to the input port of the fluid line comprising control means and a control unit;
- lowering a control unit to the seabed connecting it to the control means; and
- connecting the fluid line to the insert hydraulic downhole safety valve at the point of setting such as to provide a fluid connection between the subsea existing infrastructure and the insert hydraulic downhole safety valve via the fluid line.

The method may comprise, prior to the step of operating the hydraulically operable insert hydraulic downhole safety valve, a step of:

- connect to hydraulics infrastructure in the area, from for instance a neighboring well or a hydraulic line available in the control umbilical, or lowering a hydraulic fluid source in the form of a subsea hydraulic power unit (HPU) and a control unit subsea; and
- connecting the subsea hydraulic power unit to the input port.

Hydraulic fluid is in this context not limited to conventional hydraulic fluids, but may be any fluid available in the field, such as MEG, MeOH, scale inhibitor, corrosion inhibitor and even seawater, either directly applicable or conditioned as required, filtered, deoxygenized, desalted, etc.

This setup provides a hydraulic fluid line in the annulus, i.e. outside of the production tubing. The pre-made bore may be pre-drilled or formed by other means and may be plugged with a temporary plug which is removed only if the electric downhole safety valve malfunctions and the setting of the insert hydraulic downhole safety valve is required. A hydraulic fluid line is prepared when installing the production tubing, which the hydraulic fluid line extends from an input port at a position outside of the subsea tree to the point of setting (e.g. the implement profile).

The HPU can be installed using a ROV. If using ROV, prepare ROV installable HPU with electric control circuit for one DHSV function.

Install HPU and plug in control circuit while Wireline/coiled tubing installation of the insert hydraulic downhole safety valve is performed. This operation will be offline and not cost extra vessel time.

It is further described a subsea production system comprising:

- a subsea well;
- a subsea tree above the well, wherein the subsea tree is connected to the subsea well;
- a production tubing arranged inside the well, wherein the production tubing comprises:
- an electrically operable electric downhole safety valve;
- an implement profile arranged within the production tubing configured for receiving a hydraulically operable insert hydraulic downhole safety valve;
- a through-going bore configured to support a hydraulic fluid line in the subsea production system, wherein the fluid line extends from an input port at a position outside of the subsea tree to the point of setting in the subsea well, thereby being able to operate an insert hydraulic downhole safety valve hydraulically from a position outside the subsea tree via the through-going bore.

The system may further comprise a tubing hanger, wherein the tubing hanger comprises a hydraulic connection hydraulically connecting a first side of the tubing hanger with an opposite second side of the tubing hanger, wherein the hydraulic connection forms part of the hydraulic fluid line.

It is further described a subsea tree comprising:

- communication means for operating an electrically operable electric downhole safety valve;
- a through-going bore for a hydraulic fluid line such as to create a fluid connection from a position outside of the subsea tree to an interface for connection to a well, and being able to operate the insert hydraulic downhole safety valve hydraulically from a position outside the subsea tree. The interface can be any interface known to the skilled person and which render possible fluid communication between the subsea tree and a complementary interface on a connectable component. The connectable component is typically a tubing with a complementary interface at a position for connection to the interface on the subsea tree, however it can also be other elements than a tubing.

It is further described an electric downhole safety valve comprising an implement profile configured for receiving a hydraulically operable insert hydraulic downhole safety valve, and wherein the electric downhole safety valve further comprises a through-going opening for hydraulic fluid for hydraulically operating the hydraulically operable insert hydraulic downhole safety valve.

These and other characteristics of the invention will be apparent from the enclosed drawings, wherein;

BRIEF DESCRIPTION OF THE DRAWINGS

FIG. 2A shows an example of a typical prior art hydraulic tubing retrievable surface controlled subsurface safety valve (TRSCSSV) which is a hydraulic operated downhole safety valve with flapper;

FIG. 2B shows an example of a typical prior art hydraulic wireline retrievable surface controlled subsurface safety valve (WRSCSSV) which is a hydraulic downhole safety valve with flapper;

DETAILED DESCRIPTION OF THE INVENTION

Figures 1A, 1B:
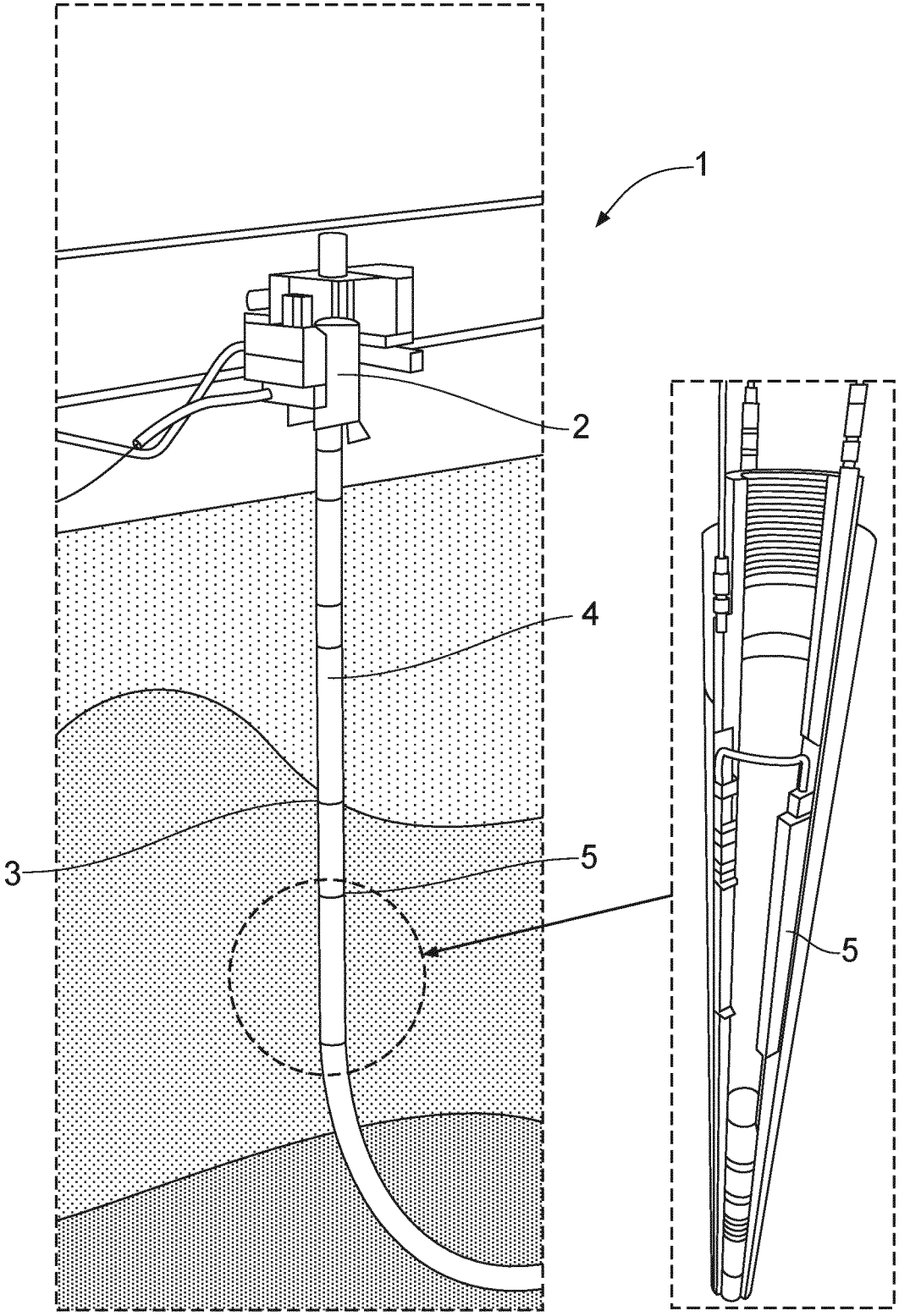
FIG. 1A is an overview of the main components forming part of the subsea production system according to the invention, including a subsea tree connected to the subsea well, a production tubing in the well, and an electric downhole safety valve in the well.
FIG. 1B is an enlarged view of section A in FIG. 1A, showing more details of the electric downhole safety valve.

In the following, embodiments of the invention will be discussed in more detail with reference to the appended drawings. It should be understood, however, that the drawings are not intended to limit the invention to the subject-matter depicted in the drawings.

FIG. 1A is an overview of the main components forming part of the subsea production system according to the invention, including a subsea tree connected to the subsea well, a production tubing in the well, and an electric downhole safety valve in the well. FIG. 1A shows the situation before the insert hydraulic downhole safety valve has been installed in the well. The electric downhole safety valve typically has a lock open mechanism, which ensures that access to the well is achieved at any time without the risk of uncontrolled closing of the bore in the production tubing. The subsea tree can be an electric subsea tree or a hydraulic subsea tree.

FIG. 1B is an enlarged view of section A in FIG. 1A, showing more details of the electric downhole safety valve.

FIG. 2A shows an example of a typical prior art hydraulic tubing retrievable surface controlled subsurface safety valve (TRSCSSV) 23, which is a hydraulic operated downhole safety valve with a flapper 24. The main functional components of the TRSCSSV 23 typically include a housing 25, a flapper function 24, a power spring 26, a hydraulic piston 27, a hydraulic chamber 28, a flow tube 29, a control line 30, and a nipple profile 31 for an insert hydraulic downhole safety valve (e.g. an insert valve run on wireline). The end of the control line 30 is connected to the valve inlet connection port, which is a threaded connection with metal-to-metal seal. This is normally done on the platform before subsea deployment. It could also be done onshore and sent to the platform as a pre-made assembly. The entire control line 30 is tested before the TRSCSSV 23 is run downhole with the production tubing (not shown in the figure, but the TRSCSSV 23 forms part of the production tubing). In order to protect the control line 30 when run downhole, it is typically clamped to the outside of the production tubing while being run down hole. Most TRSCSSV's use a single control line 30 for valve opening and the power spring 26 for valve closing because this provides the fail-safe close function upon hydraulic power supply failure. In a similar manner, an electric operated production installed downhole safety valve will be configured and operated as stay-open while being fed electric power and automatic-close when the power source is lost.

FIG. 2B shows an example of a typical prior art hydraulic wireline retrievable surface controlled subsurface safety valve (WRSCSSV) 32, which is an insert hydraulic downhole safety valve with a flapper 24*w*. The main functional modules of the WRSCSSV 32 typically include a housing 25*w*, a flapper 24*w*, a power spring 26*w*, a hydraulic piston 27*w*, a hydraulic chamber 28*w*, a control line 30*w*, a flow tube 29*w*, hydraulic seals mounted in upper and lower sealbores 34*w*, and a nipple profile 31*w* for an insert hydraulic valve (e.g., an insert valve run on wireline). The WRSCSSV 32 is a wireline retrievable surface controlled subsurface safety valve, also named an insert WRSCSSV. The WRSCSSV 32 is basically a reduced bore version of the TRSCSSV 23 with its main application being a through-tubing conveyed means for remediation of TRSCSSV failures. The WRSCSSV 32 is normally installed within the TRSCSSV 23 taking advantage of the existing hydraulic line. The WRSCSSV is installed on wireline into an applicable nipple 31*w* in the production tubing (not shown in FIG. 2B). This nipple 31*w* is normally a part of the complete TRSCSSV assembly ready for installation. The WRSCSSV 32 will, as an inserted valve, have a reduced bore ID through the valve compared to the TRSCSSV and the tubing string.

Referring to FIGS. 2A and 2B, if experiencing a leak in the hydraulic TRSCSSV 23, the operator may run an exercise tool to force flow tube 29 to an upper position. Then an inflow test of the TRSCSSV 23 is performed as a standard procedure, including increasing the pressure above the TRSCSSV 23 over a predetermined period time. When the inflow test has been performed, any debris causing the flow tube 29 not to close properly is removed. If the TRSCSSV 23 is still leaking, the WRSCSSV 32 is installed. This sequence includes the following steps:

- Prepare TRSCSSV 23 for installation of insert valve by locking open the flapper 24 and establishing communication with control line 30 into well between upper and lower sealbore. However, there may also be situations where the flapper 24 will not open due to lack of power downhole, in which event it may be impossible to lock open the flapper 24 and the flapper 24 therefore has to be opened in another way, for example by stinger or spike in e.g. a lockout/communication tool as described below.
- Run lockout/communication tool and land the tool in TRSCSSV nipple profile 31. A prong (e.g. stinger or spike) will push flapper 24 open without resistance. Jar and engage O-ring and expand locking dogs.
- Jar down aggressively to establish communication between well and control line 30. (Different need for establishing communication with control line.)
- Polish upper and lower sealbores 34*w* of insert WRSCSSV 32 before installing the insert WRSCSSV.
- Install insert WRSCSSV 32 with flapper 24*w* locked open.
- In this manner, from control line 30 and into well between the two sealbores (i.e. upper and lower sealbores) 34*w* is established,
- Tap insert WRSCSSV 32 in place until it lands in no-go. Upper and lower sealbores 34*w* will now be in place in the polished area,
- Pressure up control line 30*w* and leak test for a predetermined time. Inflow test insert WRSCSSV 32, including increasing the pressure above the WRSCSSV 32 over a predetermined period of time.

In the following, different methods of operating a subsea production system according to the invention will be described in greater detail. The methods and associated subsea production system and electric subsea tree have many common features with the installation sequence described in relation to FIGS. 2A and 2B, however according to the present invention, due to the fact there is an electric subsea tree with no hydraulic fluid to the surface, the TRSCSSV has been changed with an electrically operable electric downhole safety valve. As indicated above, FIG. 1A is an overview of the main components forming part of the electric subsea production system according to the invention, including an (all)-electric subsea tree connected to the subsea well, a production tubing in the well, and an electric downhole safety valve in the well. FIG. 1A shows the situation before the insert hydraulic downhole safety valve has been installed in the well.

Figure 3A:
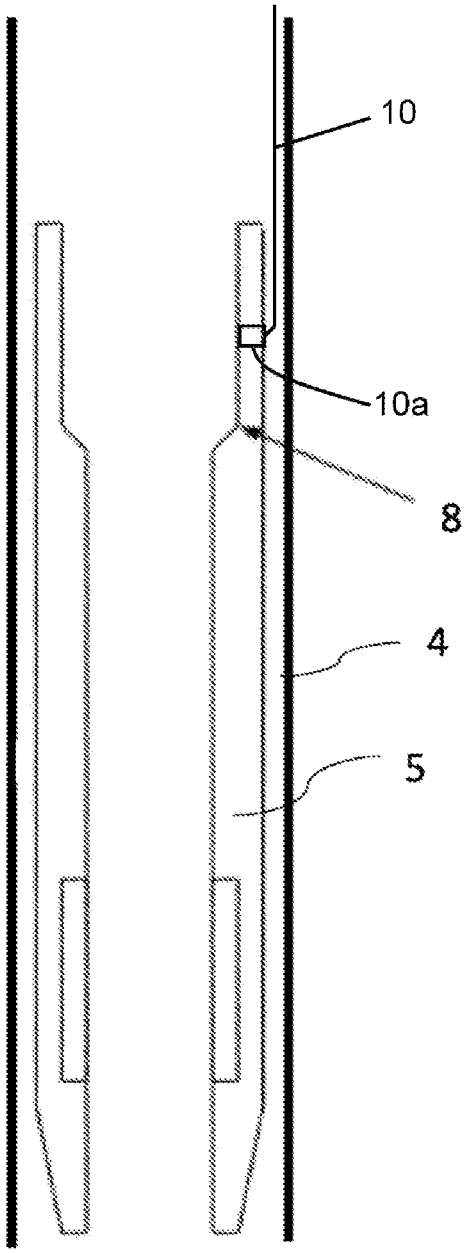
FIG. 3A shows an electric downhole safety valve comprising an implement profile configured for receiving a hydraulically operable insert hydraulic downhole safety valve without the hydraulically operable insert hydraulic downhole safety valve installed.

FIG. 3A shows an electric downhole safety valve 5 comprising an implement profile 8 configured for receiving a hydraulically operable insert hydraulic downhole safety valve, without the hydraulically operable insert hydraulic downhole safety valve installed.

Figure 3B:
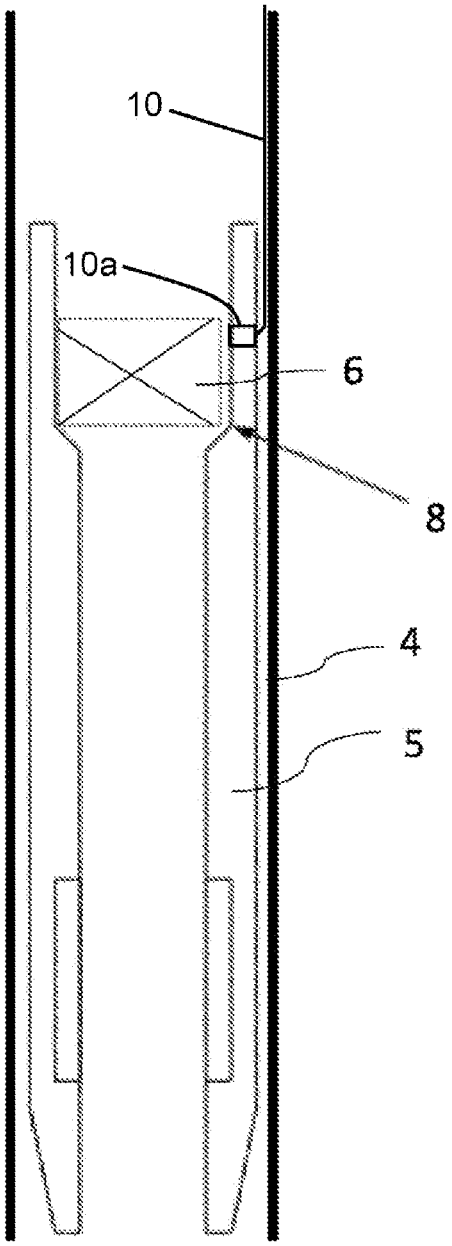
FIG. 3B shows an electric downhole safety valve comprising an implement profile configured for receiving a hydraulically operable insert hydraulic downhole safety valve with the hydraulically operable insert hydraulic downhole safety valve installed.

FIG. 3B shows an electric downhole safety valve 5 comprising an implement profile 8 configured for receiving a hydraulically operable insert hydraulic downhole safety valve 6, with the hydraulically operable insert hydraulic downhole safety valve 6 installed.

Figure 4A:
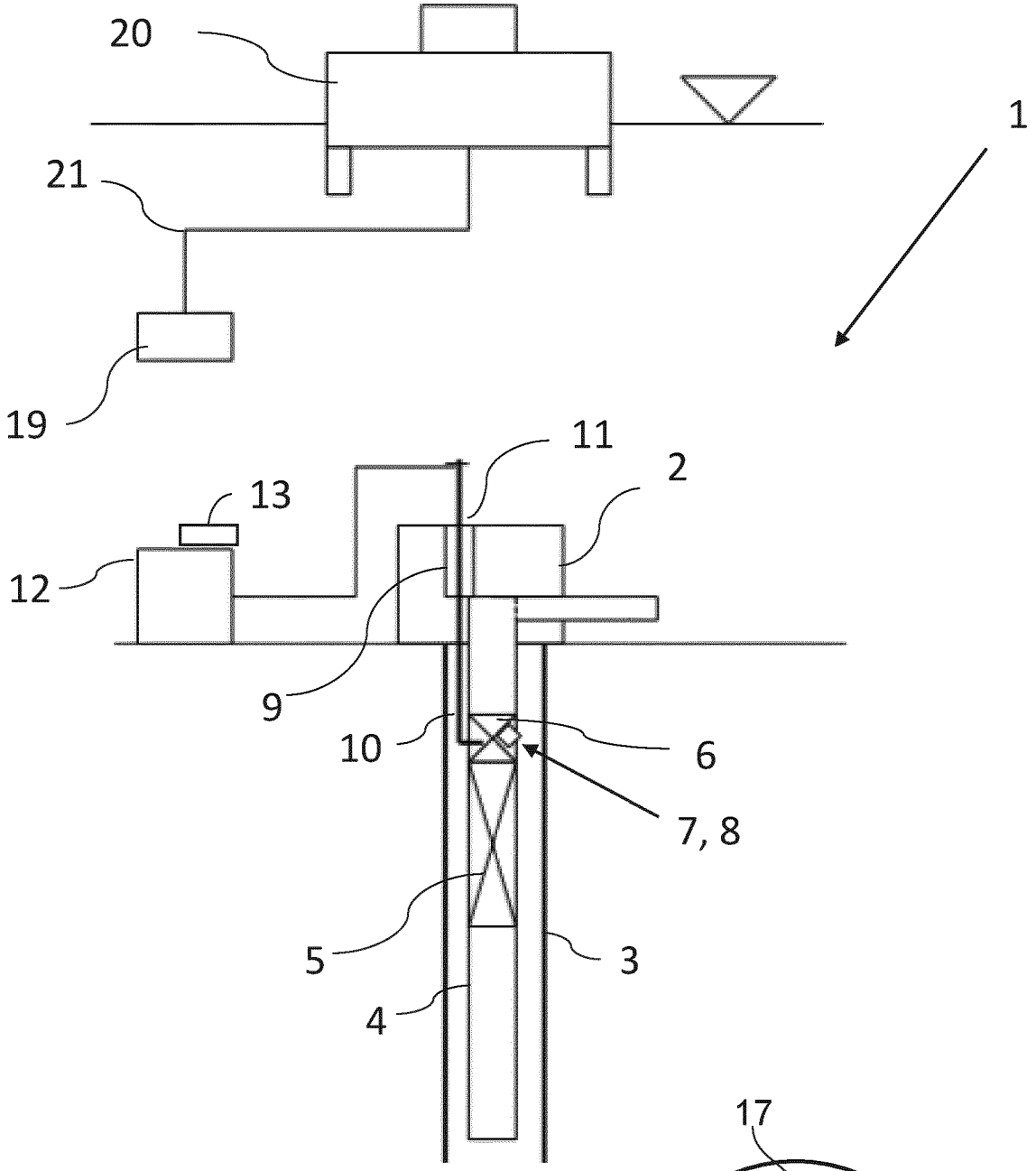
FIG. 4A shows an example of a subsea production system, the system comprising a subsea tree connected to the subsea well, a production tubing in the well, and an electrically operable electric downhole safety valve, where the subsea tree comprises a through-going bore configured to support a hydraulic fluid line in the subsea system, wherein the hydraulic fluid line extends from an input port at a position outside of the subsea tree to the point of setting.

FIG. 4A shows an example of an subsea production system 1 comprising an electric subsea tree 2 connected to the subsea well 3, a production tubing 4 in the well 3, and an electrically operable electric downhole safety valve 5. The electric subsea tree 2 comprises a through-going bore 9 configured to support a hydraulic fluid line 10 in the electric subsea system 1. The hydraulic fluid line 10 extends from an input port 11 at a position outside of the subsea tree 2 to a through-going opening 10*a* in the electic downhole safty valve 5 (FIGS. 3A-3B) which may be located near a point of setting 7 at a position at or close to the electric downhole safety valve 5. The point of setting 7 is shown as being the same position as the implement profile 8 for landing the insert hydraulic downhole safety valve 6. The hydraulic fluid line 10 extends outside of the production tubing 4 but inside the well 3. A hydraulic fluid source in the form of a subsea hydraulic power unit 12 and a control unit subsea 13 have been lowered subsea to a position at or close the electric subsea tree 2. The subsea hydraulic power unit 12 is connected to the input port 11 and the hydraulic fluid line 10 is connected to the insert hydraulic downhole safety valve 6 at the point of setting 7. As such, a hydraulic connection between the subsea hydraulic power unit 12 and the insert hydraulic downhole safety valve 6, via the hydraulic fluid line 10, has been established. In case hydraulic infrastructure is already in place in the field the subsea high-pressure unit may not be required.

A remotely operated vehicle 19 connected to a surface facility 20 via a connection line 21 may be used in assisting installation of subsea hydraulic power unit 12 and when connecting, e.g., subsea hydraulic power unit 12 to input port 11.

Figure 4B:
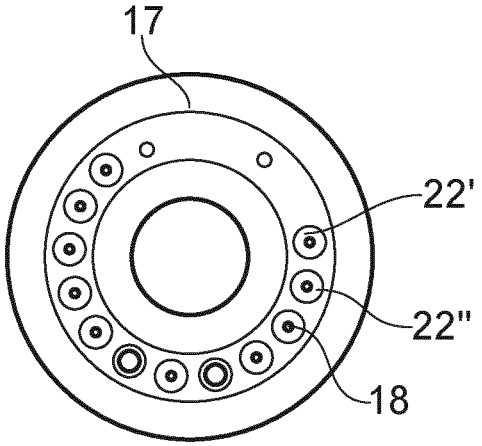
FIG. 4B shows an example of a tubing hanger to be used with the production system of FIG. 4A.

FIG. 4B shows an example of a tubing hanger to be used with the production system of FIG. 4A. The tubing hanger 17 comprises a hydraulic connection 18 hydraulically connecting a first side of the tubing hanger 17 with an opposite second side of the tubing hanger, wherein the hydraulic connection forms part of the hydraulic fluid line. The tubing hanger 17 further comprises standard connections when used in a subsea production system 1, including a connection or port 22' to a surface controlled subsea safety valve A (eSCSSV A) and a connecction or port 22" to a surface controlled subsea safety valve B (eSCSSV B).

The invention has been explained with reference to non-limiting embodiments. For example, any subsea tree with an electric downhole safety valve can be used, including an electric subsea tree, an all-electric subsea tree and a hydraulic subsea tree. Furthermore, a skilled person will understand that there may be made alternations and modifications to the embodiment that are within the scope of the invention as defined in the attached claims.

REFERENCE LIST

| | |
|---|---|
| 1 | subsea production system, |
| 2 | subsea tree |
| 3 | subsea well |
| 4 | production tubing |
| 5 | electric downhole safety valve |
| 6 | insert hydraulic downhole safety valve |
| 7 | a point of setting |
| 8 | Implement profile |
| 9 | through-going bore in tree |
| 10 | hydraulic fluid line |
| 11 | input port |
| 12 | subsea hydraulic power unit |
| 13 | Subsea control unit |
| 17 | Tubing hanger |
| 18 | hydraulic connection in tubing hanger |
| 19 | Remotely Operated Vehicle, ROV |
| 20 | Surface facility |
| 21 | connection line |
| 22' | surface controlled subsea safety valve A connection |
| 22" | surface controlled subsea safety valve B connection |
| 23 | TRSCSSV |
| 24 | Flapper |
| 24w | Flapper WRSCSSV |
| 25 | Housing (TRSCSSV) |
| 25w | Housing (WRSCSSV) |
| 26 | Power spring |
| 26w | Power spring (WRSCSSV) |
| 27 | Hydraulic piston |
| 27w | Hydraulic piston (WRSCSSV) |
| 28 | Hydraulic chamber |
| 28w | Hydraulic chamber (WRSCSSV) |
| 29 | Flow tube |
| 29w | Flow tube (WRSCSSV) |
| 30 | Control line |
| 30w | Control line (WRSCSSV) |
| 31 | Nipple profile |

-continued

| | |
|---|---|
| 31w | Nipple profile (WRSCSSV) |
| 32 | WRSCSSV |
| 34w | Hydraulic seals/Sealbores (upper and lower) |
| A | Section A |

The invention claimed is:

1. A method of operating a subsea production system, the system comprising an electric subsea tree connected to a subsea well, a production tubing in the well, and an electrically operable electric downhole safety valve, the electric subsea tree comprising a through-going bore forming part of a fluid line in the subsea production system extending down to a position at or close to the electric downhole safety valve, wherein the method comprises, in case of malfunction in operation of the electric downhole safety valve, the steps of:

installing a hydraulically operable insert hydraulic downhole safety valve into the well for positioning within the production tubing;

connecting the insert hydraulic downhole safety valve to the fluid line at a point of setting in the subsea well for operation of the insert hydraulic downhole safety valve;

operating the insert hydraulic downhole safety valve from a position outside the subsea tree using the fluid line, wherein the fluid line extends from an input port located at a position outside of the electric subsea tree to the point of setting in the subsea well via the through-going bore.

2. The method according to claim 1, wherein the system comprises an implement profile located below the electric subsea tree, and wherein the method further comprises:

installing the insert hydraulic downhole safety valve in the implement profile.

3. The method according to claim 2, wherein the implement profile is arranged between the electric subsea tree and the electric downhole safety valve.

4. The method according to claim 2, wherein the implement profile is provided in the electric downhole safety valve, and wherein during the step of installing the insert hydraulic downhole safety valve in the implement profile in the electric downhole safety valve, the electric downhole safety valve is forced into an open position, thereby inactivating the electric downhole safety valve.

5. The method according to claim 1, further comprising, prior to the step of operating the hydraulically operable insert hydraulic downhole safety valve:

lowering a hydraulic fluid source in the form of a subsea hydraulic power unit and a control unit subsea; and connecting the subsea hydraulic power unit to the input port.

6. The method according to claim 1, further comprising, prior to the step of operating the hydraulically operable insert hydraulic downhole safety valve:

installing a fluid conduit from existing infrastructure in the field to the input port of the fluid line, the existing infrastructure comprising hydraulic or chemical distribution means and control means; and lowering a control unit to the seabed and connecting the control unit to the control means; and connecting the fluid line to the insert hydraulic downhole safety valve at the point of setting so as to provide a fluid connection between the subsea existing infrastructure and the insert hydraulic downhole safety valve via the fluid line.

7. A subsea production system comprising:

a subsea well;

an electric subsea tree positioned above the well, the electric subsea tree being connected to the subsea well; and a production tubing arranged inside the well, the production tubing comprising:

an electrically operable electric downhole safety valve; and an implement profile arranged within the production tubing and configured for receiving a hydraulically operable insert hydraulic downhole safety valve; and a through-going opening for hydraulic fluid located at or near the implement profile;

a through-going bore configured to support a hydraulic fluid line in the subsea production system, the fluid line extending from an input port at a position outside of the electric subsea tree to the through-going opening, thereby enabling operation of the insert hydraulic downhole safety valve hydraulically from a position outside the electric subsea tree via the through-going bore.

8. The system according to 7, further comprising a tubing hanger which comprises a hydraulic connection hydraulically connecting a first side of the tubing hanger with an opposite second side of the tubing hanger, wherein the hydraulic connection forms part of the hydraulic fluid line.

9. An electric subsea tree comprising:

communication means for operating an electrically operable electric downhole safety valve positioned in a production tubing arranged inside a well; and a through-going bore for a hydraulic fluid line, the through-going bore enabling the creation of a fluid connection from a position outside of the subsea tree to an interface configured for connection to the well, the through-going bore being configured to support a hydraulic fluid line which extends to a through-going opening for hydraulic fluid in the electric downhole safety valve or in the production tubing at or near the electric downhole safety valve;

whereby an insert hydraulic downhole safety valve arranged within the electric downhole safety valve can be operated from a position outside the subsea tree.

10. An electric downhole safety valve comprising:

a cylindrical housing configured to be connected into a tubing string;

an implement profile in the housing configured for receiving a hydraulically operable insert hydraulic downhole safety valve; and a through-going opening in the housing for hydraulic fluid for hydraulically operating the hydraulically operable insert hydraulic downhole safety valve, the through-going opening having a first end which is connectable to a hydraulic fluid line extending outside the tubing string and a second end which is connectable to the insert hydraulic downhole safety valve when the insert hydraulic downhole safety valve is received in the implement profile.

* * * * *